US005897249A

United States Patent [19]

Aslam et al.

[11] Patent Number: 5,897,249

[45] Date of Patent: Apr. 27, 1999

[54] BELT FUSER APPARATUS FOR PREVENTING LINE ART TYPE MARKING PARTICLE OFFSET

[75] Inventors: Muhammed Aslam, Rochester; Robert D. Bobo, Ontario, both of N.Y.

[73] Assignee: Eastman Kodak Company, Rochester, N.Y.

[21] Appl. No.: 08/992,643

[22] Filed: Dec. 17, 1997

[51] Int. Cl.[6] ..... G03G 15/20

[52] U.S. Cl. ..... 399/329; 399/330

[58] Field of Search ..... 399/67, 69, 92, 399/165, 320, 328, 329, 330, 331; 430/124, 126

[56] References Cited

U.S. PATENT DOCUMENTS

| | | | |
|---|---|---|---|
| 5,070,373 | 12/1991 | Fukano et al. | 399/322 |
| 5,149,941 | 9/1992 | Hirabayashi et al. | 399/328 X |
| 5,235,393 | 8/1993 | Merle | 399/341 |
| 5,256,507 | 10/1993 | Aslam et al. | 430/42 |
| 5,339,146 | 8/1994 | Aslam et al. | 399/342 |
| 5,339,148 | 8/1994 | Johnson et al. | 399/341 |
| 5,359,401 | 10/1994 | Uehara et al. | 399/67 |
| 5,392,104 | 2/1995 | Johnson | 399/301 |
| 5,465,146 | 11/1995 | Higashi et al. | 399/328 |
| 5,485,260 | 1/1996 | Mitsuya | 399/330 |

*Primary Examiner*—Arthur T. Grimley
*Assistant Examiner*—Hoan Tran

[57] ABSTRACT

A belt fusing apparatus for providing image gloss to a colorant image formed on a receiver member by a reproduction apparatus, the belt fusing apparatus, configured to substantially prevent line art type marking particle offset. The belt fusing apparatus is disclosed as including a heated fuser roller, with a pressure roller in nip relation with the fuser roller, and a steering roller. A fusing belt is entrained about the fuser roller and the steering roller. The steering roller is located downstream of the nip between the fuser roller and the pressure roller, relative to the fuser roller to provide a wrap for the fusing belt about a portion of between 10 and 30% of the circumference of the pressure roller. Further, a cooler is provided to cool the fusing belt over such wrap.

2 Claims, 2 Drawing Sheets

BELT FUSER APPARATUS FOR PREVENTING LINE ART TYPE MARKING PARTICLE OFFSET

CROSS-REFERENCE TO RELATED APPLICATIONS

U.S. patent application Ser. No. 08/992,872, filed Dec. 17, 1997, entitled "REPRODUCTION APPARATUS PROVIDING SELECTABLE IMAGE QUALITY AND GLOSS" in the name of Muhammed Aslam et al.

U.S. patent application Ser. No. 08/992,057, filed Dec. 17, 1997, entitled "BELT FUSING ACCESSORY WITH SELECTABLE FUSED IMAGE GLOSS" in the name of Muhammed Aslam et al.

U.S. patent application Ser. No. 08/992,058, filed Dec. 17, 1997, entitled "APPLICATION OF CLEAR TONER DEVELOPED NEGATIVE TO THE IMAGE IN AN ELECTROPHOTOGRAPHIC PROCESS TO ELIMINATE IMAGE RELIEF AND DIFFERENTIAL GLOSS ARTIFACTS" in the name of William J. Staudenmayer et al.

U.S. patent application Ser. No. 08/992,746, filed Dec. 17, 1997, entitled "APPLICATION OF CLEAR MARKING PARTICLES TO IMAGES WHERE THE MARKING PARTICLE COVERAGE IS UNIFORMLY DECREASED TOWARDS THE EDGES OF THE RECEIVER MEMBER" in the name of Muhammed Aslam et al.

U.S. patent application Ser. No. 08/992,060, filed Dec. 17, 1997, entitled "COOLING AND REUSING THE HEAT TO PREHEAT THE FUSING WEB IN A BELT FUSER" in the name of Muhammed Aslam et al.

U.S. patent application Ser. No. 08/992,056, filed Dec. 17, 1997, entitled "MECHANISM FOR TRACKING THE BELT OF A BELT FUSER" in the name of Muhammed Aslam et al.

U.S. patent application Ser. No. 08/992,059, filed Dec. 17, 1997, entitled "A COLLAPSIBLE CUSTOMER REPLACEABLE BELT FUSER ASSEMBLY DESIGNED FOR ACCESSIBILITY, SERVICEABILITY, AND FUSING BELT REPLACEMENT" in the name of Muhammed Aslam et al.

U.S. patent application Ser. No. 08/992,745, filed Dec. 17, 1997, entitled "APPARATUS FOR PACKAGING AND INSTALLATION OF A FUSING BELT" in the name of Muhammed Aslarn et al.

FIELD OF THE INVENTION

This invention is directed in general to a belt fusing apparatus for a reproduction apparatus, and more particularly to a belt fusing apparatus for a reproduction apparatus, such belt fusing apparatus configured to substantially prevent line art type marking particle offset.

BACKGROUND OF THE INVENTION

Typical commercial reproduction apparatus include electrostatographic process copier/duplicators or printers, inkjet printers, and thermal printers. With such reproduction apparatus, a colorant such as pigmented marking particles, ink, or dye material (hereinafter referred to commonly as marking particles) are utilized to develop an image, of information to be reproduced, on a support member for transfer to a receiver member, or directly onto a receiver member. The receiver member bearing the marking particle image is transported through a fuser device where the image is fixed (fused) to the receiver member, for example, by heat and pressure to form a permanent reproduction thereon. While the fuser device is typically integral with the reproduction apparatus, it may also be an independent piece of equipment, generally referred to as an off line fuser. Off line fusers, being a device devoted to a single task, have the ability to have their operating parameters optimized to perform the fusing function.

Certain reproduction apparatus have been designed to produce multi-color copies. In such reproduction apparatus, multiple color separation images are respectfully developed with complimentary colored marking particles, in superposition on a receiver member. It has been found that fixing of multicolor marking particle images to a receiver member requires substantially different operating parameters than fixing standard black marking particle images to a receiver member. Moreover, the respective operating parameters may in fact be in contradistinction. That is, multi-color images require a high degree of glossiness for a full, rich depth of color reproduction; on the other hand, since glossiness for black marking particle images may significantly impair legibility, a matte finish is preferred.

It is known that the glossiness of a marking particle image is, at least in part, dependent upon the marking particle melting characteristics in the fixing process. In general, the fixing apparatus serves to soften or at least partially melt the marking particles, enabling the marking particles to permeate into the fibers of the receiver member so that the marking particles are fixed to the receiver member to give a glossy image reproduction. For example, the fusing apparatus may include a heated roller which contacts the marking particles and the receiver member. With multi-color marking particle images, the multiple color marking particle images are respectively melted and fixed by the heated roller. If the color marking particle images are not sufficiently melted, light scattering cavities may occur in the copy which degrades the color reproduction. Moreover, if the marking particles on the receiver member do not have a mirror-like surface, incident light is reflected by diffusion from the marking particle surface and is not admitted into the marking particle layers, making the colors on the receiver member appear dark and cloudy. Therefore, low melting point marking particles are used. They yield few cavities and a hard flat surface so as to give glossy and vivid colors in the reproduction.

Low melting point marking particles are subject to increased image offset to the heating roller of the fusing apparatus. This can produce undesirable defects in the reproduction or subsequent reproductions. Although image offset can be reduced by application of fuser oil to the heating roller, the use of such oil introduces further complications into the fusing system, such as handling of the oil and making sure that the layer of oil on the roller is uniform for uniform heat application. Alternatively, a mechanical arrangement for reducing image offset, without the need for fuser oil, has been found. Such mechanical arrangement, as shown for example in U.S. Pat. No. 5,256,507 (issued Oct. 26, 1993, in the name of Aslam et al), provides an elongated web which is heated to melt the marking particles and then cooled to cool the particles and facilitate ready separation of the receiver member with the marking particle image fixed thereto from the elongated web. The nature of operation of the elongated web arrangement also serves to increase the glossiness of the fixed marking particle image. As a result, such arrangement is particularly useful for multi-color image fusing. However, there is still a tendency for marking particle images, particularly of the line art type, to offset to the heating web of the fusing apparatus.

SUMMARY OF THE INVENTION

In view of the above, this invention is directed to a belt fusing apparatus for providing image gloss to a colorant image formed on a receiver member by a reproduction apparatus, the belt fusing apparatus substantially preventing line art type marking particle offset. The belt fusing apparatus is disclosed as including a heated fuser roller, with a pressure roller in nip relation with the fuser roller, and a steering roller. A fusing belt is entrained about the fuser roller and the steering roller. The steering roller is located downstream of the nip between the fuser roller and the pressure roller, relative to the fuser roller to provide a wrap for the fusing belt about a portion of between 10 and 30% of the circumference of the pressure roller. Further, a cooler is provided to cool the fusing belt over such wrap.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
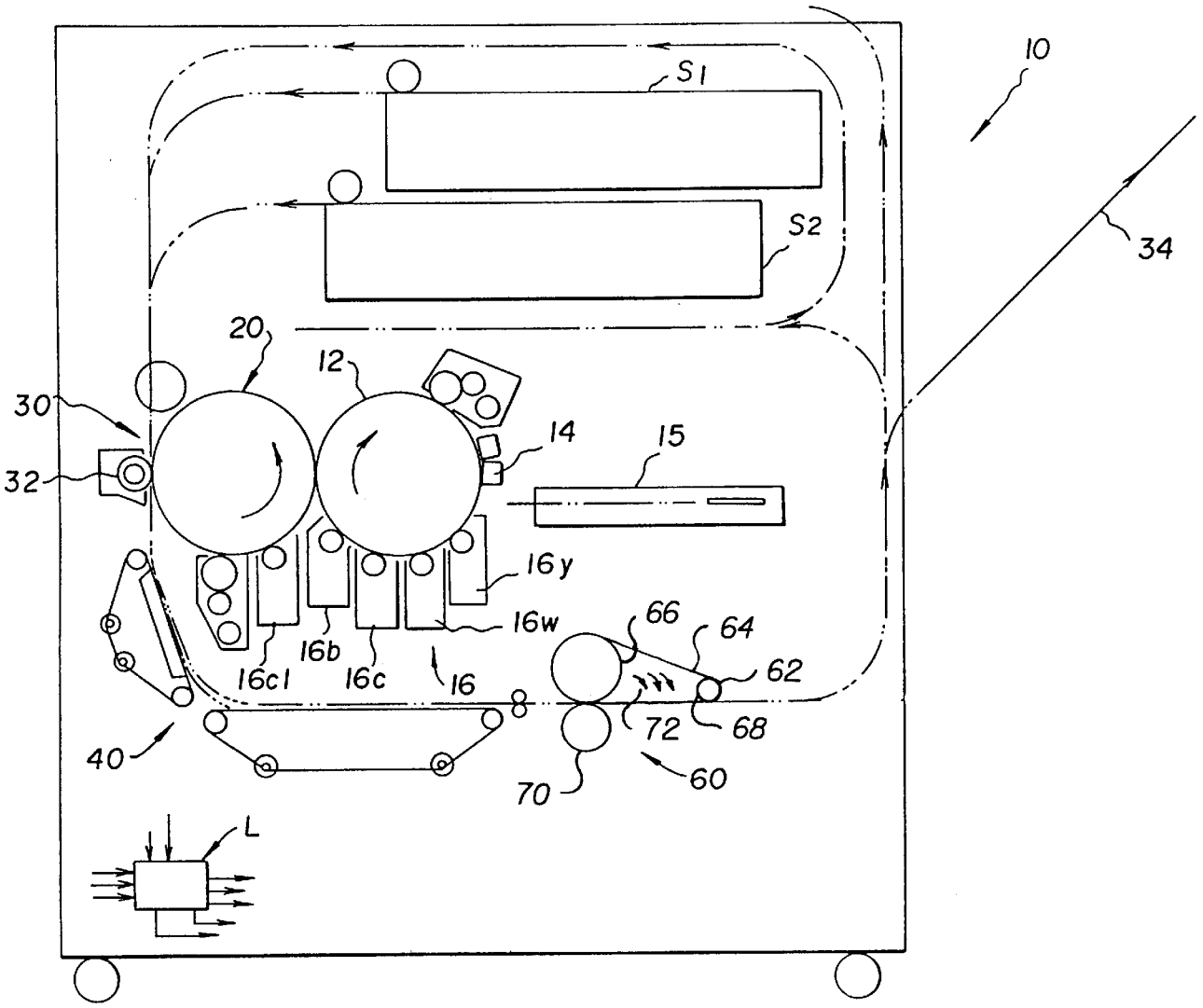
FIG. 1 is a front elevational view of an electrostatographic reproduction apparatus including a belt fusing apparatus, according to this invention, for preventing line art type marking particle image offset.
Figure 2:
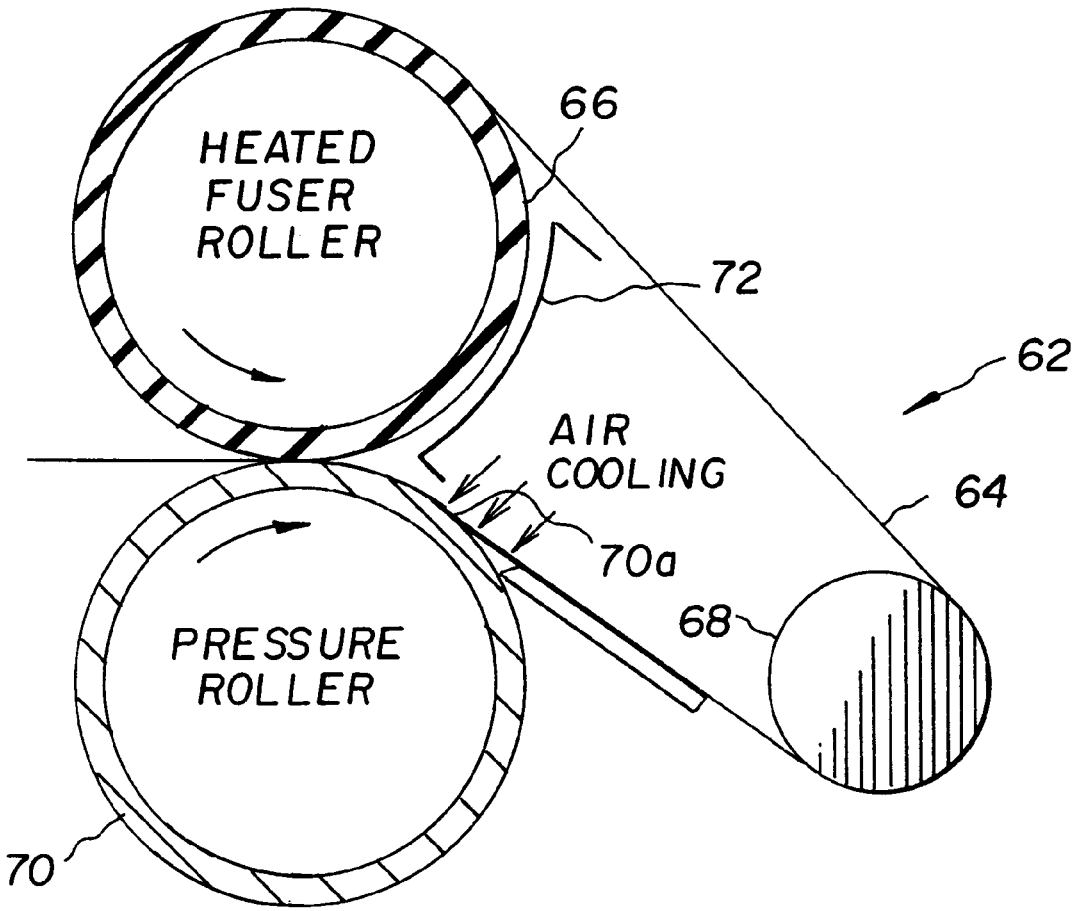
FIG. 2 is a front elevational view, on an enlarged scale, of the belt fusing apparatus, according to this invention.

Referring now to the accompanying drawings, an electrostatographic reproduction apparatus, designated generally by the numeral 10, is shown in FIG. 1. While the reproduction apparatus 10 is shown as an electrophotographic type reproduction apparatus, it is readily appreciated that the belt fusing apparatus according to this invention is suitable for use with other types of reproduction apparatus, such as ink jet printers and thermal printers.

The reproduction apparatus 10 includes a primary image forming dielectric member, for example, a drum 12 having a photoconductive surface, upon which a pigmented marking particle image, or series of different color marking particle images, is formed. In order to form images, when the photoconductive drum 12 is rotated in the direction of the arrow associated therewith, the photoconductive surface of drum is uniformly charged, and then exposed imagewise by, for example, a laser 15 or light emitting diode (LED) array, to create a corresponding latent electrostatic image. The latent electrostatic image is developed by a application of pigmented marking particles to the image bearing drum 12 by a development station 16. In the embodiment of the reproduction apparatus 10 as shown, there are five developing units, each unit having particular different color marking particles associated respectively therewith. Specifically, developing unit 16*y* contains yellow marking particles, developing unit 16*m* contains magenta marking particles, developing unit 16*c* contains cyan marking particles, and developing unit 16*b* contains black marking particles. Of course, other color marking particles (e.g. red, green, blue, etc.) may be used in the particular developing units depending upon the overall arrangement of the development station 16 and operational characteristics of the color development scheme for the reproduction apparatus 10. Additionally, a developing unit 16*cl* is provided, containing clear marking particles, which is utilized to aid in improving the quality and gloss of reproduced images, in the manner more fully described in the copending U.S. patent application Ser. No. 08/992,872, filed on even date herewith.

Each developer unit is separately activated for operative developing relation with drum 12 to apply different color marking particles respectively to a series of images carried on drum 12 to create a series of different color marking particle images. The developed marking particle image is transferred (or multiple marking particle images are transferred one after another in registration) to the outer surface of a secondary or intermediate image transfer member, for example, an intermediate transfer drum 20. Thereafter, the single marking particle image, or a multicolor image comprising multiple marking particle images respectively formed on the surface of the intermediate image transfer member drum 20, is transferred in a single step to a receiver member.

The receiver member is transported along a path (designated by chain-link lines) into a nip 30 between intermediate image transfer member drum 20 and a transfer backing member, for example a roller 32. The receiver member is delivered from a suitable receiver member supply (hopper $S_1$ or $S_2$) into nip 30 where it receives the marking particle image. The receiving member exits the nip 30, and is transported by transport mechanism 40 to a fuser assembly 60 where the marking particle image is tacked to the receiver member by application of heat and/or pressure. After tacking the image to the receiver member, the receiver member is selectively transported to return to the transfer nip 30 to have a second side (duplex) image transferred to such receiver member, to a remote output tray 34 for operator retrieval, or to an output accessory such as a sorter, finisher or belt fusing accessory.

Appropriate sensors (not shown) of any well known type, such as mechanical, electrical, or optical for example, are utilized in the reproduction apparatus 10 to provide control signals for the apparatus. Such sensors are located along the receiver member travel path and are associated with the primary image forming member photoconductive drum 12, the intermediate image transfer member drum 20, the transfer backing member roller 32, and various image processing stations. As such, the sensors detect the location of a receiver member in its travel path, and the position of the primary image forming member photoconductive drum 12 in relation to the image forming processing stations, and respectively produce appropriate signals indicative thereof. Such signals are fed as input information to a logic and control unit L including a microprocessor, for example. Based on such signals and a suitable program for the microprocessor, the unit L produces signals to control the timing operation of the various electrographic process stations for carrying out the reproduction process. The production of a program for a number of commercially available microprocessors, which are suitable for use with the invention, is a conventional skill well understood in the art. The particular details of any such program would, of course, depend on the architecture of the designated microprocessor.

According to this invention, the belt fusing apparatus 60 is similar to that shown and described in U.S. patent application No. 08/992,057, filed in the name of Aslam, et al, on even date herewith. The belt fusing apparatus described therein is a stand-alone unit which can be positioned to directly receive output from the reproduction apparatus. As such the belt fusing apparatus can be used as an off-line device or an accessory for an electrographic reproduction apparatus, inkjet, thermal printers, or any such color hard copy printing machine, where control of the gloss of the final image or to match the image gloss to that of the receiver is desired. The fusing apparatus is capable of producing high gloss (G20>90) with the image gloss being controlled by varying the fusing temperature.

The belt fusing apparatus 60, according to this invention, is shown as being integral with the reproduction apparatus 10. The belt fusing apparatus 60 includes an input transport for delivering marking particle image-bearing receiver members to a fusing assembly, designated generally by the numeral 62. The fusing assembly 62 comprises a fusing belt 64 entrained about a heated fusing roller 66 and a steering roller 68. The fusing belt 64 is, for example, a thin metallic or heat resistant plastic belt. Metal belts can be electroformed nickel, stainless steel, aluminum, copper or other such metals, with the belt thickness being about 2 to 5 mils. Seamless plastic belts can be formed of materials such as polyimide, polypropylene, or the like, with the belt thickness summarily being about 2 to 5 mils. Usually these fusing belts are coated with thin hard coatings of release material such as silicone resins, fluoropolymers, or the like. The coatings are typically thin (1 to 10 microns), very smooth, and shiny. Such fusing belts could also be made with some textured surface to produce images of lower gloss or texture.

A pressure roller 70 is located in nip relation with the heated fusing roller 66. The nip established between the pressure roller 70 and the fusing roller 66 is selected to provide an area where the fusing belt 64 wraps about an extended portion of the pressure roller circumference (between approximately 10 and 30%) to establish a wrap area 70*a*. A heat shield 72 is provided adjacent to the fusing roller 66 to limit the amount of heat radiated to the area of the fusing belt 64 remote from the fusing roller. A flow of air is directed at the wrap area 70*a* to cool such area. The cooling action provides for a commensurate cooling of a receiver member, bearing a marking particle image, while such member is held between the fusing belt 64 and the pressure roller 70.

The cooling action for the receiver member, as described above, A serves as the mechanism to substantially prevent offset of the marking particle image to the pressure roller. In prior belt fusing arrangements, with reproduced images having wide area marking particle coverage, receiver members that are polymer coated, or imaged receiver members that have a full coverage of clear marking particles, the marking particles or the polymer coating on the imaged receiver member keeps the receiver member attached to the fusing belt after the fusing nip until the receiver member is cooled and released at the steering roller. However, when the image contents are line art, typed text or $D_{min}$ areas of marking particles coverage on a receiver member (hereinafter referred to as line art type images), marking particle offset occurs to the fusing belt, especially with low viscosity marking particles (noted above as desirable for their flow in color applications). The reason for such offset is speculated to be that, in the fusing nip, marking particles as well as receiver member are heated to some temperature. However, on exit from the fusing nip, the receiver member is actually held in contact with the fusing belt by the melted marking particles. In the case of line art type images, the constituent marking particles are relatively less, and more wide spread. Accordingly, that portion of the receiver member not covered with marking particles is free to contract or expand (i.e., not held to the fusing belt). The contraction/expansion of localized areas of the receiver member induce stresses on the marking particles which are trying to keep the receiver member in contact with the fusing belt. As a result of the induced stresses, the marking particles fail cohesively before they have an adequate time to cool down and release properly at the steering roller. This results in marking particles offset on the fusing belt and the above mentioned undesirable image artifacts.

According to this invention, the fusing belt 64 is intentionally wrapped around the pressure roller 70 to describe an extended wrap area 70*a* immediately downstream of the fusing nip. As such, the contact between the pressure roller 70 and the fusing belt 64 forces the imaged receiver member to stay with the fusing belt after leaving the fusing nip. Forced air cooling is provided to the marking particle image, through the fusing belt, while imaged receiver member is held between the fusing belt and the pressure roller. The degree of wrap is selected such that upon exiting the wrap area 70, the marking particles of the image have been cooled below the glass transition temperature. The particles thus can separate from the fusing belt without resulting in any marking particle offset to the fusing belt 64.

The invention has been described in detail with particular reference to certain preferred embodiments thereof, but it will be understood that variations and modifications can be effected within the spirit and scope of the invention.

What is claimed is:

1. A belt fusing apparatus for providing image gloss to a colorant image formed on a receiver member by a reproduction apparatus, said belt fusing apparatus, configured to substantially prevent line art type marking particle offset, comprising:

a heated fuser roller;

a pressure roller in nip relation with said fuser roller;

a steering roller; and a fusing belt entrained about said fuser roller and said steering roller; wherein said steering roller is located downstream of the nip between said fuser roller and said pressure roller, relative to said fuser roller to provide a wrap for said fusing belt about a portion of between approximately 10 and 30% of the circumference of said pressure roller, and a cooler for cooling said fusing belt over said wrap.

2. The belt fusing accessory of claim 1 wherein said wrap is selected to be of an extent that upon exiting of the receiver member from said wrap, marking particles have been cooled below the glass transition temperature thereof.

* * * * *